US005621266A

United States Patent [19]

Popov et al.

[11] Patent Number: 5,621,266

[45] Date of Patent: Apr. 15, 1997

[54] ELECTRODELESS FLUORESCENT LAMP

[75] Inventors: Oleg Popov, Needham; Jakob Maya, Brookline; Edward K. Shapiro, Lexington, all of Mass.

[73] Assignee: Matsushita Electric Works Research and Development Laboraty Inc., Woburn, Mass.

[21] Appl. No.: 538,239

[22] Filed: Oct. 3, 1995

[51] Int. Cl.[6] ..... H01J 61/52; H01J 65/04

[52] U.S. Cl. ..... 313/46; 313/234; 313/607; 315/112; 315/248

[58] Field of Search ..... 313/18, 30, 42, 313/46, 485, 607, 613, 234; 315/248, 112

[56] References Cited

U.S. PATENT DOCUMENTS

| | | | |
|---|---|---|---|
| 2,030,957 | 2/1936 | Bethenod et al. | 315/248 |
| 4,010,400 | 3/1977 | Hollister | 315/248 |
| 4,568,859 | 2/1986 | Houkes et al. | 315/248 |
| 4,704,562 | 11/1987 | Postma et al. | 315/248 |
| 4,710,678 | 12/1987 | Houkes et al. | 315/248 X |
| 4,727,295 | 2/1988 | Postma et al. | 315/248 |
| 5,006,752 | 4/1991 | Eggink et al. | 313/46 |
| 5,325,018 | 6/1994 | El-Hamamsy | 315/248 X |
| 5,343,126 | 8/1994 | Farrall et al. | 315/248 |
| 5,355,054 | 10/1994 | Van Lierop et al. | 315/112 |
| 5,412,280 | 5/1995 | Scott et al. | 313/607 X |
| 5,412,288 | 5/1995 | Borowiec et al. | 315/248 |
| 5,412,289 | 5/1995 | Thomas et al. | 315/248 |

*Primary Examiner*—Nimeshkumar Patel

[57] ABSTRACT

An electrodeless fluorescent lamp and fixture is disclosed which operates at radio frequencies and contains a metallic cylinder 9 to suppress capacitive coupling between an induction coil 7 and a plasma in the envelope 1 of the lamp and simultaneously substantially reduce heat in a reentrant cavity 5. The lamp includes a bulbous envelope 1 having a conventional phosphor layer 3 disposed therein. The bulbous envelope 1 contains a suitable ionizable gaseous fill. Upon ionization of the gaseous fill, the phosphor is stimulated to emit visible radiation upon absorption of ultraviolet radiation. The reentrant cavity 5 of the bulbous envelope 1 contains an inducation coil. The cylinder 9 transfers heat from the plasma to the fixture 11 through a base 13, 13*a* on the envelope 1.

20 Claims, 2 Drawing Sheets

ELECTRODELESS FLUORESCENT LAMP

BACKGROUND OF THE INVENTION

Electrodeless fluorescent lamps are well known to the art and have a longer life than conventional tubular fluorescent lamps. Fluorescent lamps have high efficacy but their lives are still limited, even though they are substantially longer than incandescent lamps. For example, regular fluorescent lamps utilizing heated cathodes, T8 and T12 for example, consume 32–40 watts and last from 12,000 to 24,000 hours. The fundamental limitation of regular fluorescent lamps is the deterioration of the electrodes due to thermal evaporation of the hot cathode and sputtering of the cathode material (emissive coating) by the plasma ions.

Therefore one approach of the prior art has been to eliminate the electrodes and generate a plasma which is needed for visual radiation without introduction of the inner electrodes (hot cathodes). Plasma generation can be achieved by capacitively or inductively coupling electric fields in a rare gas based mixture, thereby inducing an electrical discharge operating at radio frequencies of several MHz and by a microwave plasma operating at the frequency of 916 MHz and higher.

In the typical electrodeless fluorescent lamp which utilizes an inductively coupled plasma, an induction coil is inserted inside a reentrant cavity of a bulbous envelope. The induction coil usually has several turns and an inductance of 1–3 μH. It is energized by a special driver circuit which includes a conventional matching network. The radio frequency (RF) voltage generated by the driver circuit of fixed frequency (usually 2.65 MHz or 13.56 MHz) is applied across the induction coil. This RF voltage induces a capacitive RF electric field in the bulbous envelope. When the electric field in the bulbous envelope ($E_{cap}$) reaches its breakdown value, the capacitive RF discharge ignites the gas mixture in the envelope along the coil turns. As the RF voltage applied to the coil ($V_c$) increases, both the RF coil current ($I_c$) and the magnetic field (B) generated by this current increase. However in capacitively coupled RF discharges operated at RF frequencies of a few MHz, a substantial portion of the RF power is not absorbed by the plasma but is reflected back to the driver circuitry. RF power which is not reflected is not necessarily absorbed by the plasma electrons but rather is mainly spent on the acceleration of ions in the space-charge sheath formed between the plasma and the cavity walls.

The azimuthal RF electric field ($E_{ind}$), induced by the magnetic field flux in the bulb, grows with the coil current. When $E_{ind}$ reaches a value which is high enough to maintain the inductively coupled discharge in a lamp, the RF reflected power drops and both coil RF voltage and current decrease while the lamp's visible light output increases dramatically. The further increase of RF power causes the growth of light output, $V_c$ and $I_c$.

The electrodeless RF fluorescent lamps introduced by the prior art are typically operated at RF power of 20–100 W where substantially all the RF power is inductively coupled to the RF discharge. The inductive (azimuthal) RF electric field in the plasma is low, $E_{ind}$=0.5–1.0 V/cm, which is close to that in the positive column of DC discharge. However, because the RF voltage across the coil reaches 300–500 V, the coil turns have high RF potential with respect to the bulb plasma which has a potential close to ground. The RF voltage between the coil's turns and the plasma causes a series of problems which reduce lamp life.

This voltage comprises two main parts: RF voltage across the space-charge sheath and RF voltage across the glass cavity walls. The RF voltage, which drops across the space-charge sheath, generates a direct current (DC) voltage across the sheath which accelerates ions from the plasma towards the walls. The RF electric field and hence, the DC electric field, are perpendicular to the walls so the mercury ions bombard the cavity walls coated with the phosphor and damage it. The RF voltage of a few hundred volts along the cavity walls which touch (or is close to) the induction coil generates currents along the walls that leads to the migration of sodium ions from the glass into the phosphor coating and into the plasma. The presence of sodium atoms (or ions) in the phosphor coating is detrimental to the coating causing the formation of dark spots which drastically reduces the lamp's life.

To solve this problem, a bifilar coil was suggested in and now used in some commercially available RF electrodeless fluorescent lamps. In the bifilar coil, the adjacent turns have the same RF potential of the opposite polarity which are mutually canceled. As a result, the coil turns have RF potentials close to ground. Another solution has involved the use of a Faraday cage to reduce the capacitive coupling between the coil and the plasma. However some provisions for initial plasma ignition, capacitive or other, have to be included in the lamp design.

The other problem encountered with electrodeless lamps with reentrant cavities is thermal management of the coil and cavity wall. During operation at high RF power (P>20 W), the coil and cavity wall temperature can reach 300° C. or more if no means of heat removal is provided. The dominant source of the heat is the RF plasma which heats the cavity walls and hence, the induction coil by gas collisions with the cavity walls and by infrared radiation. The coil's insulating material (typically PFA, i.e., Teflon) starts to deteriorate at 250° C. which makes the coil inoperable. Again, electrical conductivity of soda lime glass increases rapidly as the temperature grows which also aggravates the situation by increasing the sodium atoms migration to the plasma.

The prior art solution to the problem was to install a heat pipe inside the coil. The heat pipe removes heat from the coil and transfers it to the lamp base. However heat pipes are expensive and hard to construct. Furthermore heat pipes do not offer a solution to reduced capacitive coupling and improved maintenance.

An object of the present invention to provide a light source which can be substituted for an incandescent light source, high pressure mercury light source, metal halide light source, or a compact fluorescent light source.

Another object of the present invention to remove the heat from the coil and cavity in a practical manner and reduce cavity temperature to 200° C. or lower.

A further object of the present invention to reduce the capacitive coupling between the coil and plasma to protect the cavity coating and to extend considerably the lamp lifetime.

Another object of the present invention to design a single structure which simultaneously solves thermal coil/cavity problems and considerably reduces coil-plasma capacitive coupling so as to improve the maintenance of the cavity light output.

A further object of the present invention to design a cylinder which protects cavity walls from ion bombardment and provides the ignition of the RF inductive discharge at low RF voltages ($V_c$<500 V) and low RF power ($P_{ign}$<6–7 W).

An additional object of the present invention is to provide an RF electrodeless lamp which incorporates the matching network in the lamp base, and the temperature of the network components is low (Tm<90° C.) so inexpensive components could be used.

DESCRIPTION OF THE INVENTION

Figure 1:
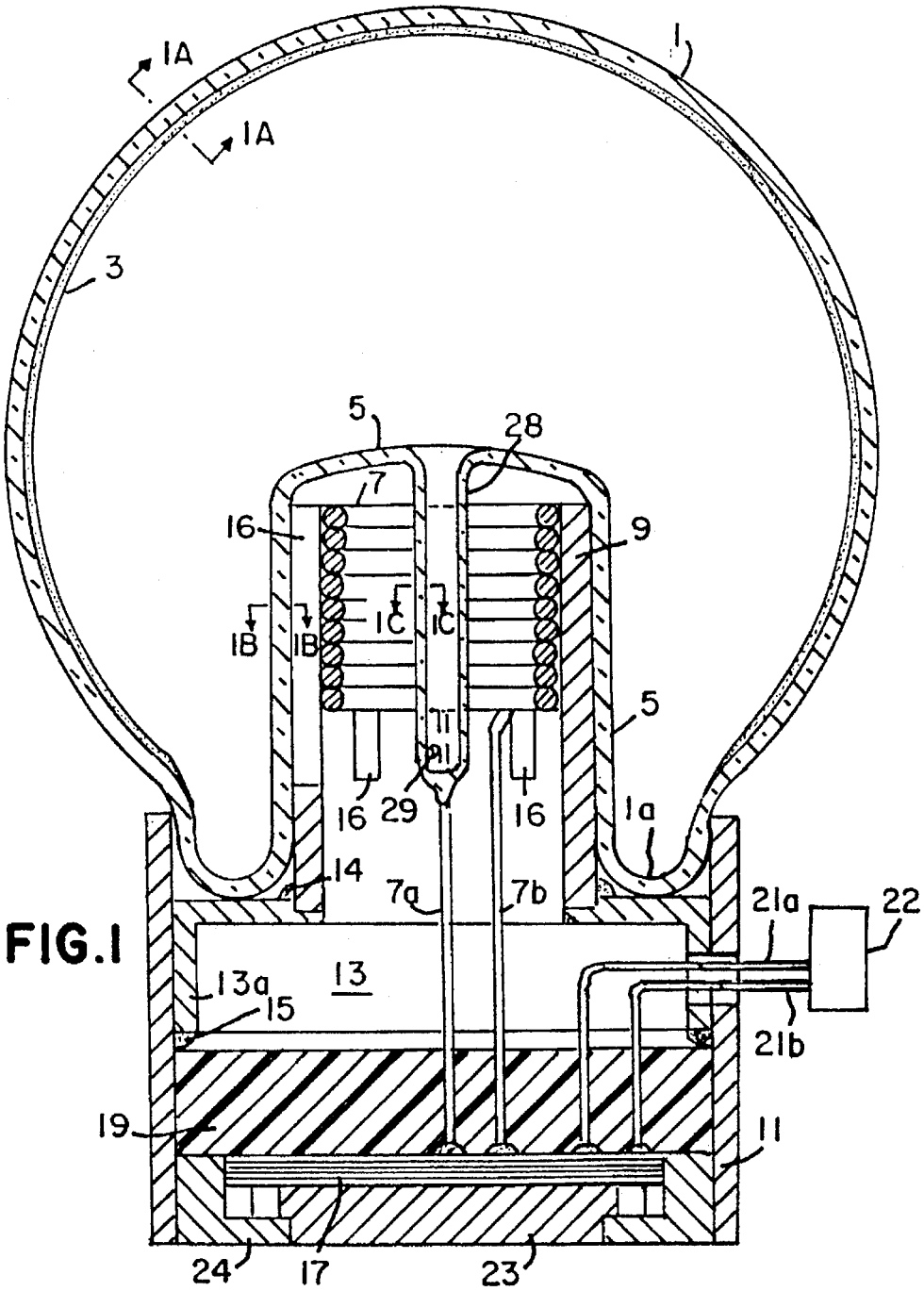
FIG. 1 is a cross-sectional elevational view of an electrodeless fluorescent lamp with a metallic cylinder and induction coil of the preferred embodiment of the present invention.

Referring now to FIG. 1, a bulbous envelope 1 is shown with a coating 3 of a conventional phosphor. A protective coating formed of silica or alumina or the like is disposed beneath the phosphor coating 3. The envelope 1 contains a suitable ionizable gaseous fill, for example a mixture of a rare gas (e.g. krypton and/or argon) and a vaporizable metal such as mercury, sodium and/or cadmium. Upon ionization of the gaseous fill, as will be explained hereinafter, the phosphor is stimulated to emit visible radiation upon absorption of ultraviolet radiation. The envelope 1 has a bottom 1*a* disposed within a cylindrical lamp fixture 11. The envelope 1 has a reentrant cavity 5 disposed in the bottom 1*a*. The protective coating is also disposed on the inner wall of the cavity 5, as is a reflective coating. A coil 7 is disposed within a cylinder 9. Cylinder 9 is made of a light, conductive material having high thermal conductivity (Al or Cu for example). The cylinder 9 is fitted in the reentrant cavity 5 between the coil 7 and the cavity walls. An exhaust tubulation 28 depends from the cavity 5. The cavity 5 extends along the axis of coil 7. The protective coating mentioned above is also disposed within the tubulation 28. A drop of mercury amalgam 29 is disposed within exhaust tubulation 28.

We have found the length of the cylinder 9 must be greater than the height of the coil 7 so the coil 7 is protected from plasma heat which is generated within the envelope 1. The coil 7 is formed of a thermally conductive metal having a low thermal expansion coefficient such as copper coated with a thin layer of silver which provides high electrical conductivity to the coil 7 such that the coil 7 maintains its shape under operating conditions, typically in the range of 50° to 200° C. depending upon the power input to the coil.

To start the lamp of the present invention, a capacitive coupling is provided between the upper regions of the reentrant cavity 5 and the coil 7. In the preferred embodiment of the present invention the cylinder 9 is attached to a support frame 13 preferably by welds 14. Such attachment reduces capacitive coupling between the coil 7 and the plasma since the cylinder 9 is electrically grounded to the fixture 11. Support frame 13 has a cylindrical flange 13*a* which fits within the fixture 11. Support frame 13 and flange 13*a* form the base of the lamp. The bottom 1*a* of the envelope rests upon the support frame 13. Preferably flange 13*a* is attached to fixture 11 by a weld 15 which can encircle the inside of the fixture 11. In this way, cylinder 9 can conduct heat from plasma in the envelope 1 through the support frame 13 and conduct it to fixture 11 for dissipation. Such dissipation is readily provided when the walls of the cylinder 9 have thicknesses between about 0.5 and 3 mm and a cylindrical diameter of 35 to 40 mm. The total cylinder cross-section is large enough to reduce the coil temperature from about 300° C. to about 160° C. as shown in the following table.

| | Tamb = 25° C. | Tamb = 25° C. | Tamb = 25° C. | Tamb = 60° C. | Tamb = 60° C. |
|---|---|---|---|---|---|
| Structure | Air Core | Al cylinder with 6 slits | Al cylinder with base and heat | Air Core sink | Al cylinder with 6 slits |
| Tcoil (°C.) | 195 | 145 | 135 | 270 | 160 |
| Tmatching network (°C.) | 105 | 98 | 68 | 114 | 87 |

Since the diameter of the reentrant cavity 5 is fixed, we have found that an increase in the walls of the cylinder 9 requires a decrease of the diameter of the coil 7. Such reduction of the coil diameter causes a decrease of the coupling coefficient between the coil 7 (primary) and the plasma (secondary). Smaller coil diameters result in an increase in the coil starting voltage and current as well as maintaining the voltage and current.

The reduction of the coil diameter causes the decrease of the coupling coefficient between the coil (primary) and the plasma (secondary):

$$k=R^2_{coil}/R^2_{plasma}\cong D^2_{coil}/D^2_{cav}$$

Smaller k results in an increase of the coil starting voltage, $V_{st}$, and current $I_{st}$, as well as maintaining voltage and current, $V_m$ and $I_m$. The insertion between the plasma and the coil of the other conductive medium, a metallic cylinder, has an effect similar to that produced by the plasma. The magnetic field generated by the coil induces the azimuthal RF current in the cylinder. This current in turn generates a magnetic field which affects the coil current. With the disposition of the metallic cylinder 9 between the coil 7 and the reentrant cavity 5, the magnetic field generated by the coil 7 induces an azimuthal radio frequency current in the cylinder 9. This current, in turn, generates a magnetic field which affects the coil current. In other words, the cylinder becomes the secondary of the RF transformer. To eliminate or substantially reduce this effect, one or more slits 16 is formed in the cylinder 9. Such slits 16 reduce the transformer effect of the cylinder 9. While slits in the cylinder 9 are the preferred embodiment, cages made of wires or interleaved strips can also provide similar beneficial effects.

The slits 16 also can reduce eddy currents which occur in a conductive surface which is exposed to an electromagnetic field of flux. Such eddy currents could consume a substantial amount of RF power in the cylinder 9, up to 15 W. Such consumption can make it almost impossible to ignite the RF discharge at a medium RF power. The slits 16 are disposed in the cylinder wall parallel to the axis of the cylinder. With four slits, the starting RF power is between 10 and 12 W and with eight slits the power is between 5 and 6 W. The RF voltage across the coil is reduced from 450 V to between 330 and 350 V. The starting RF current is reduced from 3.5 A to 2.5 A when the number of slits 16 is increased from 4 to 8. Preferably, the open areas formed by the slits 16 constitutes between about 5 and 40% of the surface area of the cylinder 9.

Furthermore, we have found the starting voltage is dependent on the position of the turns of the coil 7 inside of the cylinder 9. As the distance between the top edge of the coil 7 and the top edge of the cylinder 9 increases, the current and starting voltages increases. At distances greater than 5 mm the starting voltage exceeds 800 V and it is practically impossible to ignite and RF discharge at an RF power less than 20 W. We have found to have a low and stable starting voltage, the distance between the edge of the coil 7 and the edge of the cylinder 9 should be no more than about 1 mm. The coil RF maintaining voltage, which maintains the inductively coupled discharge at 30–60 W, does not change noticeably due to the cylinder 9.

The heat removed from the cavity 5 by means of the cylinder 9 is transferred into the lamp fixture by means of the support frame 13 and 13*a*. The support frame 13 is mechanically and electrically connected to the lamp fixture 11. To transfer heat to this site, the heat removed from the cavity 5 is conducted from the axis of the bulbous envelope 1 to the cylinder 5 and the support frame 13 that is attached to the fixture 11.

The presence of the grounded, slotted cylinder 9 between the RF coil and the RF discharge also reduces the electromagnetic interference (EMI) due to the suppression of the capacitive coupling between the coil 7 and the plasma. This makes the lamp more acceptable for wide applications including residential ones. The cylinder 9 can be composed of several different materials to optimize the heat reduction and reduced electromagnetic interference (EMI) by means of reduction in capacitive coupling.

The heat removed from the cavity 5 via the metallic cylinder 9 is transferred to the lamp fixture 11 which is attached to the bottom of the lamp base 13 and works as a heat sink. A conventional matching network 17 is disposed in the bottom of the fixture 11 for the operation of the lamp. The coil 7 is connected to the matching network in a conventional manner by wires 7*a* and 7*b* in which wire 7*b* serves as a ground to the matching network 17. Usually, solder or brazing is an appropriate means of forming the electrical connection. Conventional powering wires 21*a* and 21*b* from a power supply 22 are connected to the matching network 17. These wires, 21*a* and 21*b*, pass through openings in the flange 13*a* and fixture 11. An insulator 19, sometimes made of plastic, is disposed between support frame 13 and the matching network 17. The matching network 17 is held within the fixture 11 by an end cap 23 held in place by flanges 24. Temperatures were measured at the induction coil 7 and matching network 17 for a lamp in the base up burning position. With an aluminum cylinder at an ambient temperature of 60° C. and RF power of ≅60 W., the coil temperature is 160° C. and the matching network temperature is below 90° C. In addition, the cylinder and support frame can be formed of metals of different thicknesses at different portions to optimize the operation of the lamp and the heat transfer characteristics as well as reduced EMI.

While it has been disclosed above to use a cylinder welded to a support frame and flange, a metal stamping can be used to make the entire structure from a single piece of metal. This single piece of metal could be stamped from a sheet metal and utilize a variety of progressive dies and all necessary slits, windows and/or holes cut during this single operation. From a manufacturing point of view this approach is probably the most economical. Naturally, if stamping the whole structure in one piece is not the preferred way, two or more pieces could be stamped out and appropriately joined together.

Figure 2:
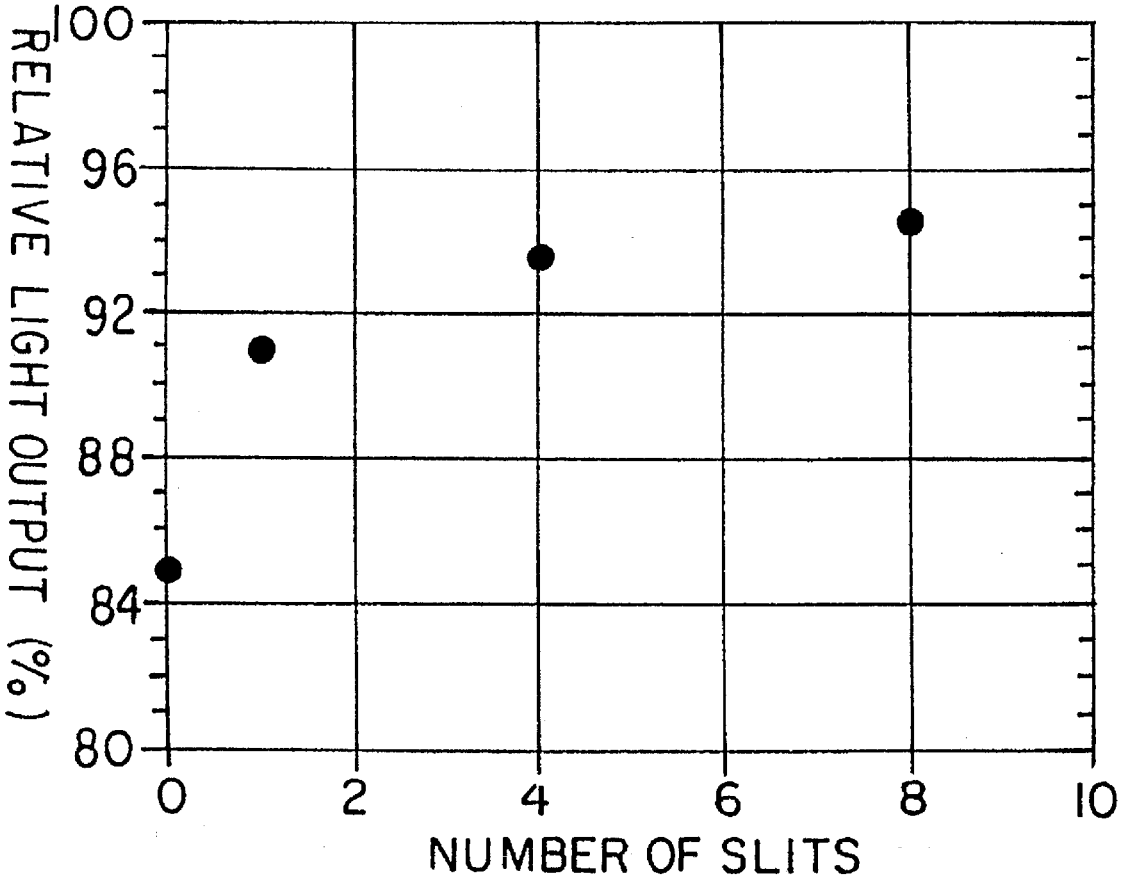
FIG. 2 is a chart showing the increase of the lamp's luminosity varying with the number of slits in the metallic cylinder.

The electrodeless RF fluorescent lamps having metallic structures used for better cavity and coil thermal management and for the increasing the lamp life time were tested for light output and compared with that from a lamp having no metallic cylinder. Metallic cylinders of the same diameter and length but different numbers of slits (0, 1, 4, and 8) were explored. The results of relative light output measurements are shown in FIG. 2. The diameter of the cavity of the lamps tested was 36 mm and the height of the cavity was 65 mm. The RF power was 58 W. It is seen that when the cylinder has no slits, the lamp lost about 16% of its light output (when compared with a lamp having no cylinder, 100%). Increasing the number of slits to 4 causes an increase of light output to 94%. Increasing the number of slits from 4 to 8 results in only a 1% gain of light output. A further increase in the number of slits seems not to give a noticeable effect on lumen output.

Figure 1A:
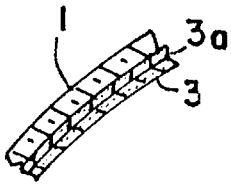
FIGS. 1A, 1B and 1C are enlarged cross sectional segments of glass surfaces within the lamp showing the coatings and taken at various locations on the envelope.
Figure 1B:
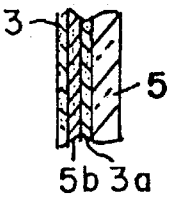
Figure 1C:
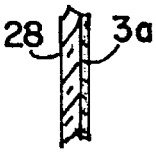

Referring to FIG. 1A, the glass envelope 1 is shown with a layer of phosphor 3. The figure is taken at the lines 1A—1A. A protective layer 3*a* of silica or alumina is disposed between the phosphor layer and the envelope to prevent migration of alkali metal ions from the glass to mix with mercury ions within the envelope. In FIG. 1B depicting a portion of the reentrant cavity 5, a reflective layer 5*b* of alumina is additionally disposed between the phosphor layer 3 and the protective layer 3*a*. FIG. 1B is taken at the lines 1B—1B. In FIG. 1C, the protective coating 3*a* is disposed on the tubulation 28. FIG. 1C is taken at the lines 1C—1C.

It is apparent that modifications and changes can be made within the spirit and scope of the present invention, but it is intention, however, only to be limited by the scope of the appended claims.

What we claim is:

1. An electrodeless fluorescent RF lamp and fixture comprising:

a bulbous lamp envelope and a reentrant cavity disposed in said envelope, a rare gas and vaporizable metal fill in said envelope and a phosphor coating on the interior thereof for generation of visible light;

a lamp base disposed outside said envelope and said fixture being attached to said lamp base;

an induction coil and radio frequency excitation generating means associated with said coil for the generation of a plasma to produce radiation to excite said phosphor coating, said coil and said means being situated outside said envelope and fitted within said cavity;

means disposed in said cavity to remove heat generated by said plasma from said cavity and said coil, said means further suppressing capacitive coupling between said coil and said plasma whereby to reduce ion bombardment of the phosphor coating on the inner surface of said cavity thereby improving the light depreciation rate and contributing to a long life lamp.

2. The lamp and fixture according to claim 1 wherein said means disposed in said cavity is a metallic cylinder fitted around said coil, said cylinder being formed of a metal with high thermal conductivity whereby heat from said envelope is transmitted to said cylinder thereby reducing cavity temperatures.

3. The lamp and fixture according to claim 2 further including a support frame, said support frame being attached to said cylinder whereby to redirect heat from cylinder.

4. The lamp according to claim 3 wherein said support frame is connected to said fixture to transmit heat from said cylinder to said fixture.

5. The lamp and fixture according to claim 1 further including a matching network disposed in said fixture.

6. An electrodeless fluorescent RF lamp and fixture comprising:

a bulbous lamp envelope and a reentrant cavity disposed in said envelope, a rare gas and vaporizable metal fill in said envelope and a phosphor coating on the interior thereof for generation of visible light through a plasma formed in said envelope;

a lamp base and said fixture disposed outside said envelope;

an induction coil and radio frequency excitation generating means associated with said coil for the generation of radiation to excite said phosphor coating, said coil and said means being situated outside said envelope and fitted within said cavity;

a cylinder fitted around said coil, said cylinder being formed of a metal with high thermal conductivity, said cylinder being disposed in said cavity to remove heat from said cavity and for suppressing capacitive coupling between said coil and said plasma and reduce ion bombardment of said phosphor coating thereby improving light depreciation rate to contribute to lengthening of the life lamp, said cylinder having an array of open areas disposed thereon whereby to reduce induced azimuthal, RF and eddy currents in said cylinder.

7. The lamp and fixture according to claim 6 wherein said cylinder is grounded so the capacitive coupling between said coil and said plasma is substantially reduced.

8. The lamp and fixture according to claim 7 further including a matching network disposed in said fixture.

9. The lamp and fixture according to claim 6 wherein said cylinder has a thickness between about 0.5 and 3 mm.

10. The lamp and fixture according to claim 6 wherein said cylinder has an array of longitudinal extending slits disposed therein, the open area formed by said slits constituting between about 5 and 40% of the surface area of said cylinder.

11. The lamp and fixture according to claim 6 wherein there are between about 2 and 6 slits in said cylinder.

12. The lamp and fixture according to claim 6 wherein said coil and said cylinder each have top ends, the top end of said coil being on substantially the same plane as the top end of said cylinder.

13. An electrodeless fluorescent RF lamp and fixture comprising:

a bulbous lamp envelope and a reentrant cavity disposed in said envelope, a rare gas and vaporizable metal fill in said envelope and a phosphor coating on the interior thereof for generation of visible light through a plasma formed in said envelope;

a lamp base disposed outside said envelope;

an induction coil and radio frequency excitation generating means associated with said coil for the generation of radiation to excite said phosphor coating, said coil and said means being situated outside said envelope and fitted within said cavity;

a cylinder fitted around said coil, said cylinder being formed of a metal with high thermal conductivity, a support frame and a circumferential flange on said support frame, said cylinder being disposed on and attached to said frame, said support frame being disposed within and attached to said fixture whereby to remove heat from said cavity and for suppressing capacitive coupling between said coil and said plasma and reduce ion bombardment of said phosphor coating thereby improving light depreciation rate to contribute to lengthening of the life lamp.

14. The lamp and fixture according to claim 13 wherein said cylinder has an array of open areas disposed thereon whereby to reduce induced azimuthal, RF and eddy currents in said cylinder.

15. The lamp and fixture according to claim 13 wherein said cylinder is grounded so the capacitive coupling between said coil and said plasma is substantially reduced.

16. The lamp and fixture according to claim 13 wherein said coil and said cylinder each have top ends, the top end of said coil being on substantially the same plane as the top end of said cylinder.

17. The lamp and fixture according to claim 13 wherein said cylinder has a thickness between about 0.5 and 3 mm.

18. The lamp and fixture according to claim 13 wherein said cylinder has an array of longitudinal extending slits disposed therein, the open areas formed by said slits constituting between about 5 and 40% of the surface area of said cylinder.

19. The lamp and fixture according to claim 18 wherein there are between about 2 and 6 slits in said cylinder.

20. The lamp and fixture according to claim 13 further including a matching network disposed in said fixture.

* * * * *